US006131641A

United States Patent [19]

Schroeder

[11] Patent Number: 6,131,641

[45] Date of Patent: Oct. 17, 2000

[54] RETRACTABLE GUIDE FOR FLEXIBLE PARTITION

[75] Inventor: Edward A. Schroeder, Marengo, Ill.

[73] Assignee: Porter Athletic Equipment Company, Broadview, Ill.

[21] Appl. No.: 09/413,791

[22] Filed: Oct. 7, 1999

[51] Int. Cl.[7] ..... A47G 5/02

[52] U.S. Cl. ..... 160/242; 160/243; 160/268.1; 160/310

[58] Field of Search ..... 160/41, 120, 121.1, 160/122, 188, 189, 241, 242, 243, 244, 245, 268.1, 310

[56] References Cited

U.S. PATENT DOCUMENTS

| | | | |
|---|---|---|---|
| 1,113,181 | 10/1914 | Ardito | 160/242 |
| 1,508,640 | 9/1924 | Blanchard | 160/242 |
| 1,870,730 | 8/1932 | Hyland | 160/242 |
| 2,215,179 | 9/1940 | Hyland | 160/242 |
| 2,811,321 | 10/1957 | La Barre | 160/242 X |
| 3,263,735 | 8/1966 | Vecchiarelli | 160/242 |
| 4,298,048 | 11/1981 | Roller | 160/243 |
| 4,846,241 | 7/1989 | Chomka et al. | 160/268.1 X |
| 4,987,942 | 1/1991 | Eriksson | 160/243 |
| 5,016,701 | 5/1991 | Vore | 160/241 |
| 5,429,171 | 7/1995 | Hamilton | 160/243 |
| 5,520,236 | 5/1996 | Thomas et al. | 160/243 X |
| 5,524,693 | 6/1996 | Hamilton | 160/243 |
| 5,752,557 | 5/1998 | Crider et al. | 160/121.1 |
| 5,785,105 | 7/1998 | Crider et al. | 160/243 |
| 5,819,835 | 10/1998 | Broome | 160/243 |

*Primary Examiner*—Bruce A. Lev
*Attorney, Agent, or Firm*—Barnes & Thornburg

[57] ABSTRACT

A flexible partition includes a curtain secured to a support structure at its topped edge and a shaft secured to the curtain displaced from the top edge and extending across the curtain. A driver is coupled to the shaft to rotate the shaft, thereby rolling and unrolling the curtain. A carriage connected to one end of the driver cooperates with a guide to restrict the rotation of the first end of the driver. The guide is pivotally coupled at one end to the support structure to move between raised and lowered positions.

17 Claims, 3 Drawing Sheets

RETRACTABLE GUIDE FOR FLEXIBLE PARTITION

BACKGROUND AND SUMMARY OF THE INVENTION

The present invention relates generally to flexible partitions, and more specifically, to a guide for a curtain with an integrated wind-up device.

It is well known to utilize flexible sheet material curtains which roll up and down to divide a partition in a large room, such as in a gymnasium. In most cases, an electric motor drives the shaft on which the curtain is hung. One particular style of roll up includes a shaft in the center of the curtain and the motor mounted within the shaft. This is shown in U.S. Pat. Nos. 5,429,171 and 5,524,693. Such a prior art system is also shown in FIGS. 1–3. The motor in the center of the roll has one or both ends secured by a carriage which rides up and down a tube or guide, the other end drives the center roll to wind the curtain onto and off of the center roll to raise and lower the curtain. After the curtain is rolled up, the wall tube or track still is extending down. In certain installations, this is undesirable. Where a guide is or could not be provided, the torque compensation arm of U.S. Pat. No. 5,524,693 is required.

The flexible partition of the present invention includes a curtain secured to a support structure at its top edge and a shaft secured to the curtain displaced from the top edge and extending across the curtain. A drive is coupled to the shaft to rotate the shaft, thereby rolling the curtain. A carriage connected to one or both ends of the driver is received in a guide to restrict the rotation of the first end of the driver. The guide is pivotally coupled at its upper end to the support structure to move between a raised and lowered position. The guide in the raised position is substantially horizontal. The carriage and guide in the raised position of the guide is adjacent the support structure.

In one embodiment, the guide includes a first portion pivotally coupled to the support structure and the second portion extends at an angle to the first portion. The carriage travels in the first portion between the raised and lowered position of the guides. The second portion of the guide, in the raised position, is substantially horizontal. The length of the second portion and the angle between the first and second portions of the guide are selected such that the second portion of the guide is substantially horizontal in the raised position of the guide.

Other objects, advantages and novel features of the present invention will become apparent from the following detailed description of the invention when considered in conjunction with the accompanying drawings.

DETAILED DESCRIPTION OF THE PREFERRED EMBODIMENTS

Figure 1:
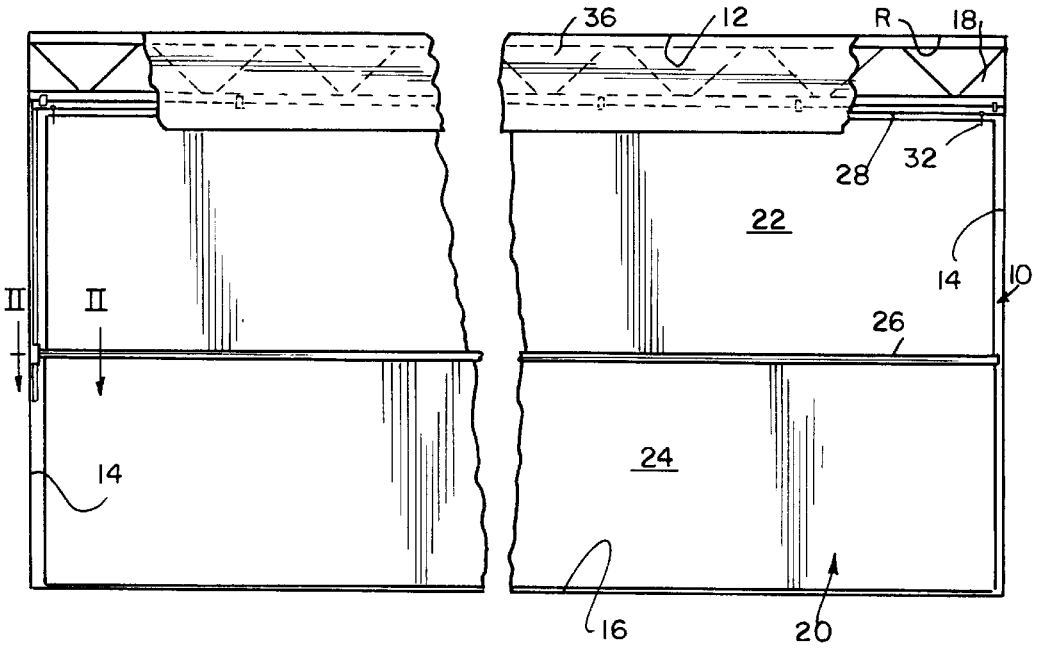
PRIOR ART FIG. 1
FIG. 1 is a front elevation of a flexible partition of the prior art fully deployed.
Figure 2:
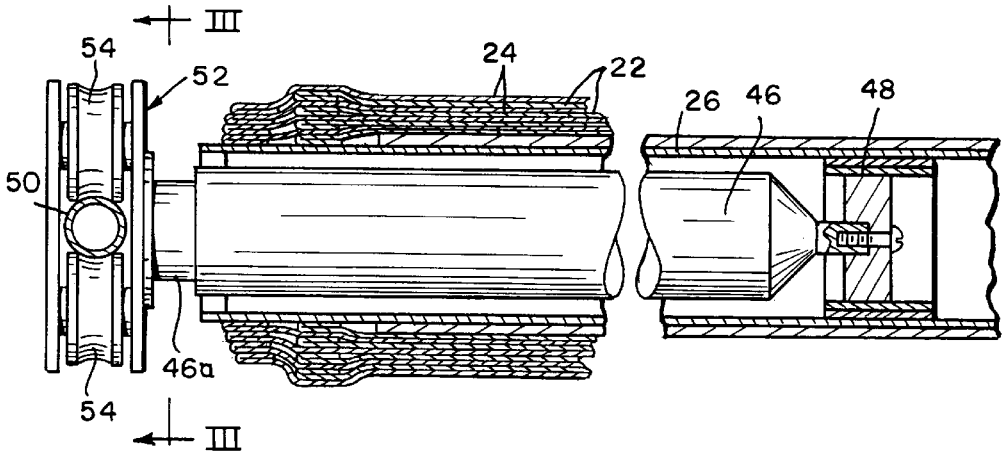
PRIOR ART FIG. 2
FIG. 2 is an enlarged cross-section taken along lines II—II of FIG. 1.

Referring to FIGS. 1 and 2, there is shown a flexible partition 10 being fully deployed in a Room R. The room R might be a gymnasium or other large room such as in an industrial factory or a convention hall. The room R includes a ceiling 12, a floor 16, and side walls 14. The partition 10 is shown as being hung from a truss girder or support structure 18 extending from one wall 14 to the other lateral side wall 14 and supporting the ceiling 12.

The flexible partition includes a curtain 20 which in this case is made up of an upper portion 22 and a lower portion 24. A shaft 26 is connected to and separates the upper portion 22 from the lower portion 24.

Figure 3:
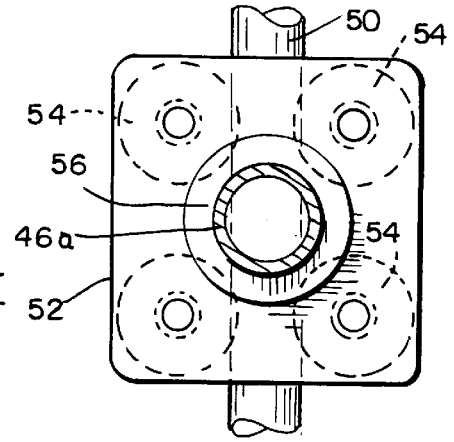
FIG 3 PRIOR ART
FIG. 3 is a cross-section taken along lines III—III of FIG. 2.

Referring now to FIG. 3, the upper edge of the curtain 20 is suspended from the girder 18 by a track 28. Hangers 32, which fit in grommets provided near the upper edge of the upper portion 22 of the curtain 20, connect the curtain 20 to the track 28.

A valance 36 may be suspended from the ceiling 12 and connected to the upper edge of the upper portion 22 of the curtain 20, a shown in FIG. 1.

A motor 46 is provided within the hollow portion of the shaft 26, at least at one end and includes a rotary drive connection 48 as shown in FIG. 2. The other end of the motor 46 is connected by an extension 46*a* and flange 56 to a carriage 52 to which is mounted four idler wheels 54 as shown in FIGS. 2 and 3. The idler wheels 54 are adapted to surround a suspended tube 50. When the motor 46 is driven to rotate the shaft 26 by the rotary drive connection 48, the reaction is to resist the torque and thus to prevent the rotation of the motor provided by the carriage 52 on the suspended tube 50. It is contemplated that other torque reaction devices could be used including a fixed vertical guide member, a folding torque arm, fixed guide wires, or a retractable cable.

Although the fixed guide is unobtrusive or not a safety hazard when it is mounted adjacent a side wall 14, there may be installations where the partition is in the middle of the space. Thus, a fixed guide is not and may not be feasible.

In operation, when it is required to wind up the curtain, the motor 46 is activated to rotate the rotary drive connection 48 and thus rotate the shaft 26. Both the upper portion 22 and the lower portion 24 of the curtain 20 will simultaneously be rolled up on the shaft 26 as the cylinder 26 climbs on the upper portion 22.

A weight may also be provided at the lower edge of the lower portion 24 in order to properly hang the curtain 20.

The above description of the prior art devices in FIGS. 1–3 have been with reference to U.S. Pat. No. 5,429,171. The same numbers have been used such that if more detailed explanation is needed, the reference can be made thereto.

Figure 4:
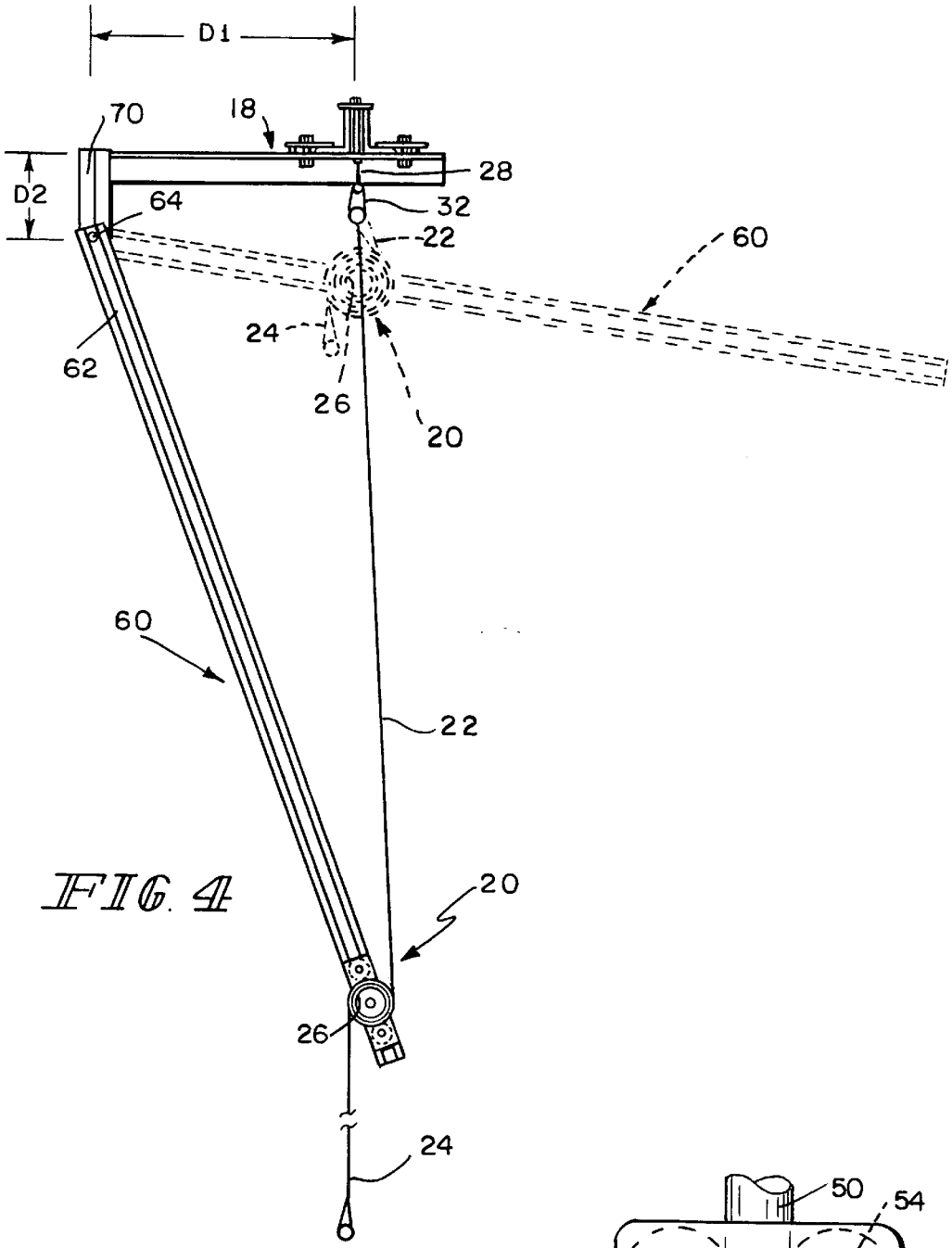
FIG. 4 is a side elevation of a flexible partition and guide according to a first embodiment of the present invention.
Figures 5, 6:
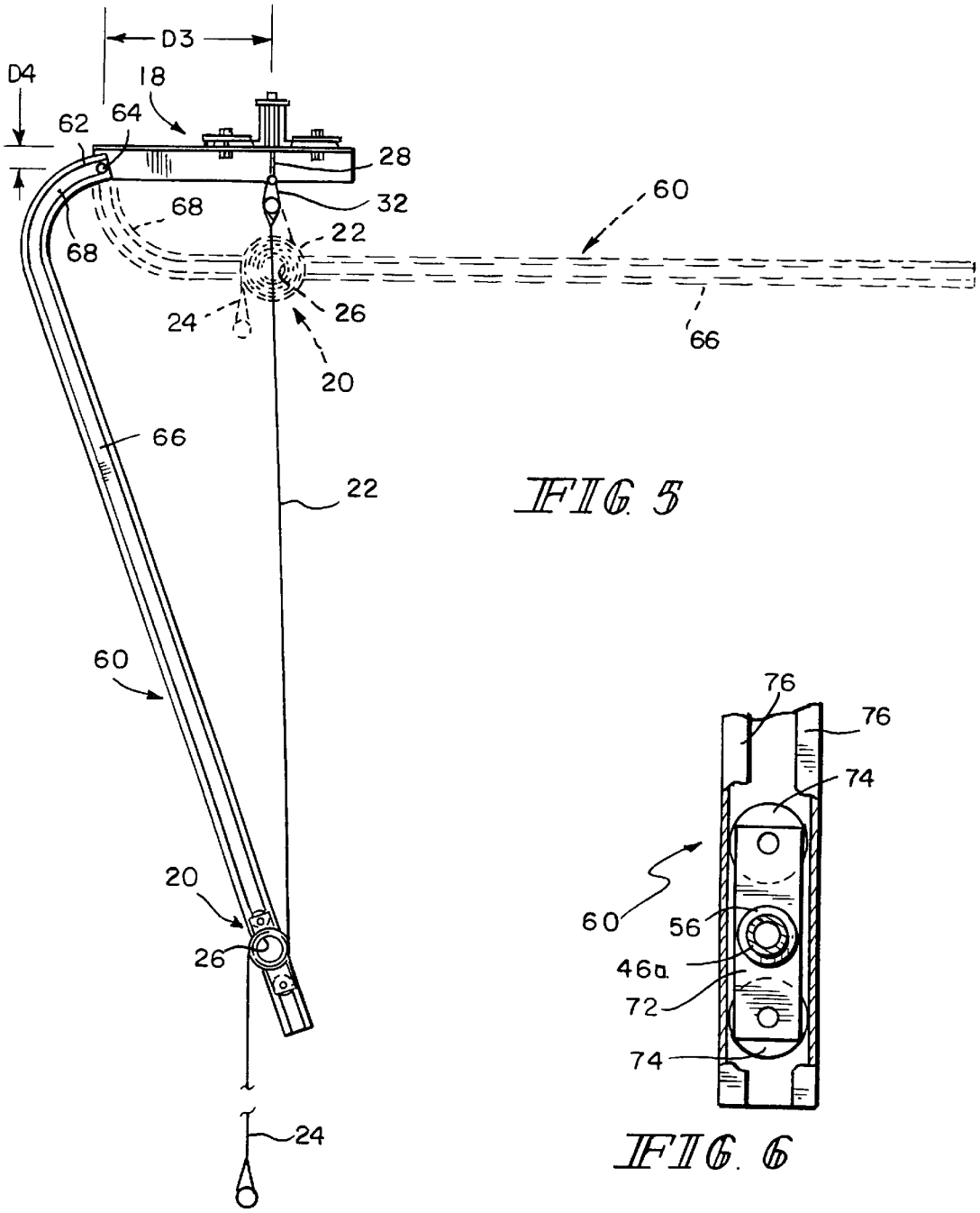
FIG. 5 is a side elevation of a flexible partition and guide according to a second embodiment of the present invention.
FIG. 6 is an enlargement of the carriage of FIGS. 4 and 5.

The improved guides of FIGS. 4 and 5 are replacement of the tube 50, fixed vertical guide member, folding torque arm, a fixed guide wires or retractable cable described in U.S. Pat. No. 5,429,171. The curtain 20 with the shaft 26 and motor 46 therein is identical to that described for FIGS. 1–3. It should also be noted that it may include any other structure wherein the shaft 26 is mounted displaced from the top edge of the curtain 20 so as to rise and lower as it rolls and unrolls the curtain 20. Though the specific structure of FIGS. 1–3 have been used as an example, the present invention is not to be limited to that particular structure.

The guide 60 of FIGS. 4–6 is pivotally connected at a first end 62 about pivot points 64 to the support structure 18. Wherein the guide 60 in FIG. 4 is a straight continuous element, the guide 60 in FIG. 5 includes a first portion 68 and a second portion 66 at an angle with respect to each other. In both Figures, the curtain 20 is shown in the lowered position in solid and its raised position in phantom. In the raised position of FIG. 4, the guide 60 is substantially horizontal and in FIG. 5, is almost completely horizontal. The length of the first portion 68 and the angle between portion 66 and 68 accommodates the difference between the position of the pivot point 64 and the totally raised position of the rolled curtain 20 so as the second portion 66 is horizontal in the raised position. In FIG. 4 to allow the guide 60 to be as horizontal as possible, the pivot point 64 is connected to the trusts or support structure 18 by a bracket 70 welded to or coupled to the support structure 18.

The distance D1 between the center line of the shaft 26 and the pivotal connection 64 for the guide 60 and the distance D2 between the top of the support structure 18 and the pivot point 64 of FIG. 4 are larger than the distance D3 between the center line of the shaft 26 and the pivot point 64 and the distance D4 between the top of the support structure 18 and the pivot point 64 of FIG. 5. This allows a more compact structure. Both of the structures in FIGS. 4 and 5 raise the guide 60 out of the area where people walk and athletes may play.

The carriage 72 illustrated in FIG. 6 includes a pair of rollers or wheels 74 on opposite sides of the connection of the end of the motor 46*a* and flange 56 to the carriage 72. The guide 60 is U-shaped having flanges 76 overlapping the carriage 72 and the wheels 74. This provides protection from foreign objects getting caught between the carriage 72 and the guide 60, as well as keeping dirt and other materials out. The prior art also includes a pair of rollers in a channel. The guide 60 may also be a tube or rod which is pivotally connected at its top end and the two rollers 74 or four rollers as in FIG. 3 run on the rod.

Also, the guide 60 and the carriage 72 may be provided at both ends of the shaft 26.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. A flexible partition having a raised and lowered condition, the partition comprising:

a curtain having top, bottom and side edges, a support structure for securing the top edge;

a shaft secured to the curtain displaced from the top edge and extending across the curtain;

a driver coupled to the shaft to rotate the shaft thereby rolling the curtain onto and off the shaft between the lowered and raised conditions of the partition;

a carriage connected to a first end of the driver;

a guide pivotally coupled adjacent a first end and adjacent the top edge of the curtain, the guide cooperating with the carriage to restrict the rotation of the first end of the driver; and wherein the carriage engages the guide such that as the curtain moves between a raised position and a lowered position, the curtain remains in a substantially constant vertical plane, and the carriage travels along the guide between the first end of the guide and a second end of the guide and thereby pivots the guide between a raised position and a lowered position.

2. A flexible partition according to claim 1, wherein the guide in the raised position is substantially horizontal.

3. A flexible partition according to claim 1, wherein the driver is inside the shaft.

4. A flexible partition according to claim 1, wherein the guide includes a first portion adjacent the first end which is pivotally coupled to the support structure, and a second portion extending at an angle to the first portion.

5. A flexible partition according to claim 4, wherein the carriage travels along the second portion between the raised and lowered positions of the guide.

6. A flexible partition according to claim 4, wherein the second portion of the guide in the raised position is substantially horizontal.

7. A flexible partition according to claim 4, wherein the length of the second portion and the angle between the first and second portions of the guide are such that the second portion of the guide is substantially horizontal in the raised position of the guide.

8. A flexible partition according to claim 1, wherein the shaft is secured to the curtain intermediate the top and bottom edges.

9. A flexible partition according to claim 1, wherein the guide is a channel and the carriage moves in the channel.

10. A flexible partition according to claim 1, wherein the guide is a rod and the carriage moves on the rod.

11. A flexible partition comprising:

a curtain having top, bottom and side edges, a support structure for securing the top edge;

a shaft secured to the curtain displaced from the top edge and extending across the curtain;

a driver coupled to the shaft to rotate the shaft thereby rolling the curtain onto and off the shaft;

a carriage connected to a first end of the driver; and a guide receiving and cooperating with the carriage to restrict the rotation of the first end of the driver, the guide including a first portion pivotally coupled to the support structure adjacent the top edge of the curtain, and a second portion extending at an angle to the first portion, wherein as the carriage travels along the guide between the first end and a second end of the guide, the curtain remains in a substantially constant vertical plane, and the guide pivots between a raised position and a lowered position.

12. A flexible partition according to claim 11, wherein the carriage travels along the second portion between raised and lowered positions of the guide.

13. A flexible partition according to claim 11, wherein the second portion of the guide in a raised position of the guide is substantially horizontal.

14. A flexible partition according to claim 11, wherein the length of the second portion and the angle between the first and second portions of the guide are such that the second portion of the guide is substantially horizontal in a raised position of the guide.

15. A flexible partition according to claim 11, wherein the shaft is secured to the curtain intermediate the top and bottom edges.

16. A flexible partition according to claim 11, wherein the guide is a channel and the carriage moves in the channel.

17. A flexible partition according to claim 11, wherein the guide is a rod and the carriage moves on the rod.

* * * * *